US010449545B2

(12) United States Patent
Lindblom

(10) Patent No.: US 10,449,545 B2
(45) Date of Patent: Oct. 22, 2019

(54) FEEDING CENTER PLATE IN A PULP OR FIBER REFINER

(71) Applicant: Valmet AB, Sundsvall (SE)

(72) Inventor: Thommy Lindblom, Hägersten (SE)

(73) Assignee: Valmet AB (SE)

( * ) Notice: Subject to any disclaimer, the term of this patent is extended or adjusted under 35 U.S.C. 154(b) by 0 days.

(21) Appl. No.: 15/752,063

(22) PCT Filed: Oct. 5, 2016

(86) PCT No.: PCT/SE2016/050952

§ 371 (c)(1),
(2) Date: Feb. 12, 2018

(87) PCT Pub. No.: WO2017/061936

PCT Pub. Date: Apr. 13, 2017

(65) Prior Publication Data

US 2018/0229242 A1 Aug. 16, 2018

(30) Foreign Application Priority Data

Oct. 8, 2015 (SE) ..... 1551300

(51) Int. Cl.
*B02C 7/12* (2006.01)
*D21D 1/30* (2006.01)
*B02C 7/06* (2006.01)

(52) U.S. Cl.
CPC ..... *B02C 7/12* (2013.01); *B02C 7/06* (2013.01); *D21D 1/30* (2013.01); *D21D 1/306* (2013.01)

(58) Field of Classification Search
USPC ..... 162/261
See application file for complete search history.

(56) References Cited

U.S. PATENT DOCUMENTS 4,191,338 A 3/1980 Lyons et al.
4,676,440 A 6/1987 Perkola
(Continued)

FOREIGN PATENT DOCUMENTS

CN 101324035 A 12/2008
CN 104919112 A 9/2015
(Continued)

OTHER PUBLICATIONS

Chinese Search Report for Chinese Application No. 201680052135.X dated Dec. 11, 2018.
(Continued)

*Primary Examiner* — Mark Halpern
(74) *Attorney, Agent, or Firm* — Lerner, David, Littenberg, Krumholz & Mentlik, LLP

(57) ABSTRACT

A center plate for a rotor in a pulp refiner has a surface provided with at least one feeding wing for directing ligno-cellulose-containing material towards a periphery of the center plate. The at least one feeding wing is an elongated protrusion arranged such that its second end is arranged further away from a center of the center plate than a first end and is also displaced relative to the first end in a direction opposite to a direction of rotation of the rotor. The at least one feeding wing includes at least one opening allowing steam to flow through the opening in a direction having a component directed opposite to the direction of rotation.

17 Claims, 10 Drawing Sheets

(56) References Cited

U.S. PATENT DOCUMENTS

| | | | | |
|---|---|---|---|---|
| 6,227,471 | B1 | 5/2001 | Virving | |
| 2012/0018549 | A1 | 1/2012 | Gingras | |
| 2016/0023216 | A1 | 1/2016 | Lonngren | |
| 2018/0236455 | A1* | 8/2018 | Lindblom | ..... B02C 7/12 |

FOREIGN PATENT DOCUMENTS

| | | | |
|---|---|---|---|
| DE | 202006002999 | U1 | 6/2007 |
| WO | 8705643 | A1 | 9/1987 |
| WO | 2014142732 | A1 | 9/2014 |

OTHER PUBLICATIONS

International Search Report for PCT/SE2016/050952 dated Dec. 13, 2016.

* cited by examiner

FEEDING CENTER PLATE IN A PULP OR FIBER REFINER

CROSS-REFERENCE TO RELATED PATENT APPLICATIONS

The present application is a national phase entry under 35 U.S.C. § 371 of International Application No. PCT/SE2016/050952 filed Oct. 5, 2016, published in English, which claims priority from Swedish Application No. 1551300-5 filed Oct. 8, 2015, all of which are incorporated herein by reference.

TECHNICAL FIELD

The present invention generally relates to refining of lignocellulose-containing material, and more particularly to a center plate for a rotor in a pulp or fiber refiner, as well as a pulp or fiber refiner with a rotor comprising such a center plate.

BACKGROUND

A commonly used pulp or fiber refiner comprises a rotor unit and a stator unit (or alternatively, two rotor units) that are aligned along a common axis and facing each other, for grinding lignocellulose-containing material, such as wood chips, into pulp. The refining of the pulp/fiber is performed in a bounded area between the rotor unit, or rotor, and the stator unit, or stator. FIG. 1 is a schematic illustration of a part of an embodiment of a pulp/fiber refiner 1 viewed from above. During use of the pulp/fiber refiner 1 of FIG. 1 lignocellulose-containing material 7, such as wood chips, is fed into the preheater 2. Steam 8 is input at the bottom of the preheater 2 and goes upwards through the pile of wood chips. The wood chips are discharged from the preheater 2 by a discharge screw 2*a* and fed into a feed screw 3*a* which feeds the chips via a feeding channel 3 towards the defibrator 4. The wood chips are fed by the feed screw 3*a* through a hole in the stator 5 to emerge in an area bounded by the stator 5 and the rotor 6. The rotor 6 facing the stator 5 is arranged on a rotatable axis that can be rotated by means of an electrical motor. The purpose of the rotor is to grind the lignocellulose-containing material between a surface of the stator and a surface of the rotor. Thus, when lignocellulose-containing material leaves the feeding channel and enters the bounded area, or refining gap/disc gap, between the rotor and the stator it flows in on the rotor and due to the rotation of the rotor the lignocellulose-containing material, such as wood chips/fiber/pulp, is directed outwards towards the periphery of the rotor and stator. Usually there are provided refining segments on the surfaces of the rotor and/or the stator. The purpose of these refining segments is to achieve a grinding action on the pulp/fiber.

The lignocellulose-containing material should be fed through the refiner as evenly as possible in order to save energy and promote an even grinding of the pulp/fiber. Usually the material feed in a refiner typically varies with time t in a more or less periodic fashion as schematically illustrated in FIG. 2A. Ideally these feed variations should be kept at a minimum to save energy and improve fiber quality. It is therefore important to achieve an even feed into the feed screw, as well as minimal disturbance from back-streaming steam from the defibrator, as will be described further below.

The defibration difficulty of each individual wood piece fed into a refiner also typically varies with time t as schematically illustrated in FIG. 2B, and these variations should also be kept at a minimum. The defibration difficulty per wood piece typically depends on e.g. wood density, wood moisture, chip size, cooking condition etc.

One problem with common refiner designs is that the chips/fiber/pulp will be directed towards the periphery of the rotor and stator in an uneven fashion. Large chunks of material will be localized in some positions of the rotor/stator arrangement while other positions will be more or less devoid of material. This will in turn lead to uneven grinding of the pulp/fiber. Thus, efforts have to be made to improve the distribution of the material.

Another problem within the art is that part of the lignocellulose-containing material initially can get stuck in the middle of the rotor. This might lead to material piling up in the middle of the rotor which can negatively affect the pulp/fiber distribution. A known measure to achieve a more even pulp/fiber distribution is to provide the rotor surface with a center plate 10, as illustrated in FIG. 3. The purpose of the center plate is to help feeding the lignocellulose-containing material 7 towards the periphery of the rotor 6 and stator 5. Such a center plate is typically provided with a set of feeding bars or "wings" or wing profiles, whose purpose is to direct the chips/fiber/pulp more evenly towards the rim of the stator/rotor arrangement. An example of a prior art center plate 10 with feeding wings 100 is schematically illustrated in FIG. 4. The wings are usually elongated protrusions provided on the surface 200 of the center plate of the rotor, where the surface 200 is facing the incoming material flow. The wings are usually curved e.g. in an arc-shaped form, but straight wings are also possible. By means of such wings pulp/fiber will be directed into the open channels defined between adjacent wings to thereby give a more even distribution of the pulp/fiber in the refining area. The center plate can have different amount of wings, and the wings may have different angles on the center plate, but the wings are always arranged in such a way that the feeding angle of the wings enable feeding of the lignocellulose-containing material towards the periphery of the center plate, depending on the direction of rotation of the rotor and center plate. The feeding angle of a feeding wing is defined by the angle between the leading edge of the wing at a given point and a radial line passing through that point. The leading edge is the edge of the feeding wing directed in a same direction as the direction of rotation, and the feeding angle has a positive value in a direction opposite to the direction of rotation. Thus, a feeding angle that enables feeding of the material towards the periphery of the center plate is >0° but <90°.

This is illustrated in FIG. 4, where a rotation of the rotor and center plate 10 in the direction of rotation 11 will cause at least part of the lignocellulose-containing material 7 to flow along the feeding wings 100 in a direction towards the periphery of the center plate 10. Prior art feeding wings commonly go all the way from the center to the periphery of the center plate.

WO 2014/142732 A1 shows a center plate for a rotor in a pulp refiner. The center plate has a surface provided with a plurality of first wings for directing pulp flowing onto the center of the center plate towards the periphery of the plate, where the surface is a flat surface or a surface with a central protuberance and where each of the first wings is an arc-shaped protrusion extending between a corresponding first point and a corresponding second point on the surface. The first point is displaced from the center point of the plate and the second point is arranged further from the center point than the first point. The first wings are given an arc-shape that yields a larger pulp feeding angle than a circular arc intersecting the center point of the center plate and ending in the same corresponding second point.

However, there is continued need in the art to further improve the pulp/fiber distribution in a pulp/fiber refiner. Therefore, there is still a need for a feeding center plate which further improves the pulp/fiber distribution in the refining area of a pulp/fiber refiner.

SUMMARY

It is an object to provide a feeding center plate which further improves the pulp/fiber distribution in the refining area of a pulp or fiber refiner.

This and other objects are met by embodiments of the proposed technology.

According to a first aspect, there is provided a center plate for a rotor in a pulp or fiber refiner, where the center plate has a surface provided with at least one feeding wing for directing lignocellulose-containing material flowing onto the surface towards a periphery of the center plate. The at least one feeding wing is an elongated protrusion extending between a first end and a second end, where the second end is arranged further away from a center of the center plate than the first end. The second end is displaced relative to the first end in a direction opposite to a direction of rotation of the rotor and center plate. The at least one feeding wing is provided with at least one opening allowing steam to flow through the opening or openings in a direction having a component directed opposite to the direction of rotation, when the center plate is rotating in the direction of rotation.

According to a second aspect, there is provided a pulp or fiber refiner with a rotor comprising a center plate as defined above.

Some advantages of the proposed technology are:

- Back-streaming steam can more easily enter the feed screw and escape, resulting in less feed conflicts, which in turn leads to lower energy consumption, less feed variations and less build-ups of material in the center of the center plate
- Less wood chip feed variations are transferred into the working disc gap, which means that a more open disc gap can be used to achieve the same defibration/refining, which results in lower specific energy (SEC) for the same fiber quality, more uniform fiber quality, longer overall fiber length and longer refiner segment lifetime.

Other advantages will be appreciated when reading the detailed description.

BRIEF DESCRIPTION OF THE DRAWINGS

The invention, together with further objects and advantages thereof, may best be understood by making reference to the following description taken together with the accompanying drawings, in which.

DETAILED DESCRIPTION

Figure 1:
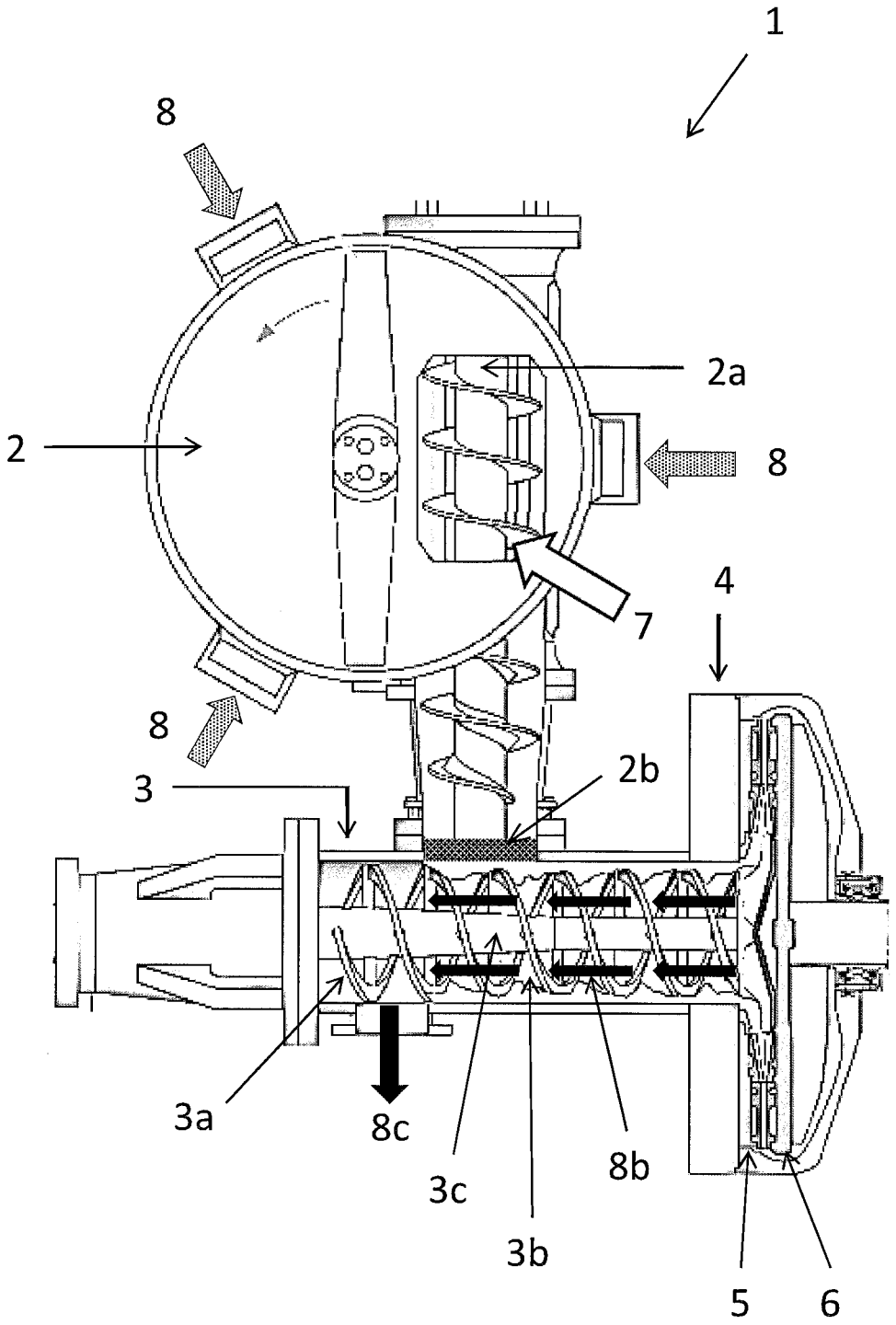
FIG. 1 is a schematic illustration of a part of an embodiment of a typical pulp/fiber refiner.
Figure 2A:
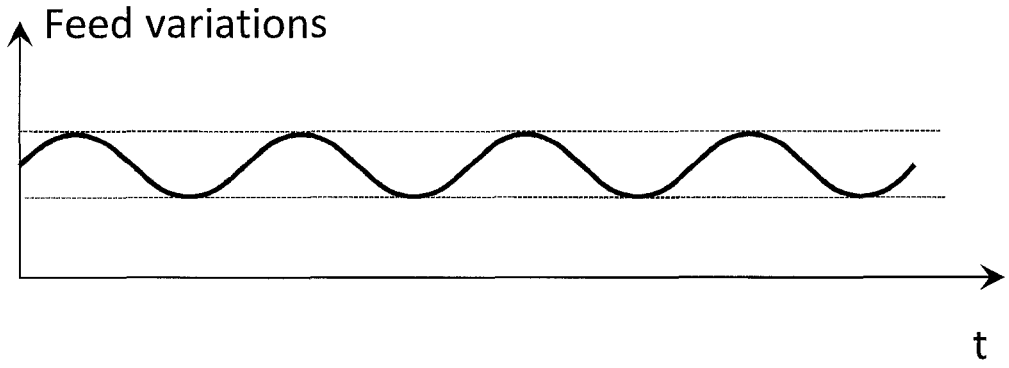
FIG. 2A is a schematic illustration of typical material feed variations in a refiner.
Figure 2B:
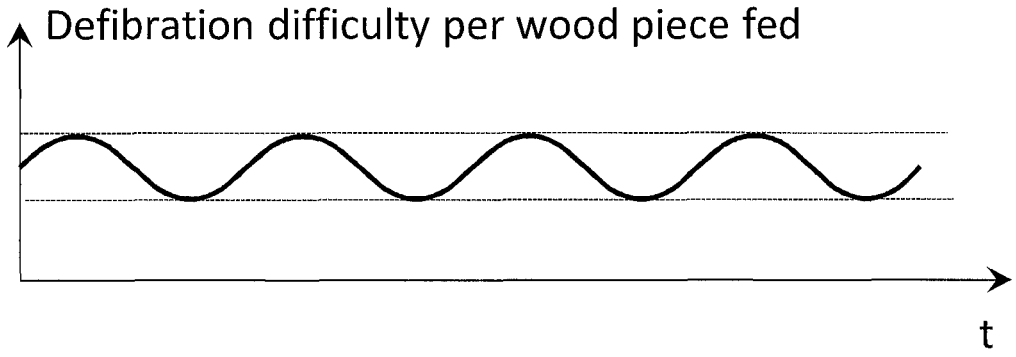
FIG. 2B is a schematic illustration of typical variations in defibration difficulty per wood piece fed into a refiner.

The present invention generally relates to refining of lignocellulose-containing material, and more particularly to a center plate for a rotor in a pulp or fiber refiner, as well as a pulp or fiber refiner with a rotor comprising such a center plate.

Throughout the drawings, the same reference designations are used for similar or corresponding elements.

As described in the background section there is continued need in the art to further improve the pulp/fiber distribution in a pulp/fiber refiner. Thus, there is still a need for a feeding center plate which further improves the pulp/fiber distribution in the refining area of a pulp/fiber refiner.

As described above, FIG. 1 is a schematic illustration of a part of an embodiment of a pulp or fiber refiner 1. Lignocellulose-containing material 7, such as wood chips, is fed into the preheater 2. Steam 8 is input at the bottom of the preheater 2 and goes upwards through the pile of wood chips. The wood chips are discharged from the preheater 2 by a discharge screw 2*a* and fed into a feed screw 3*a* which feeds the chips via a feeding channel 3 towards the defibrator 4 and through a hole in the stator 5 to emerge in the refining gap between the stator 5 and the rotor 6.

When the lignocellulose-containing material enters the refining gap between the rotor and the stator, some of the moisture in the chips/fiber/pulp is turned into steam. Some of this steam wants to go backwards against the flow of chips/fiber/pulp. Therefore, as illustrated in FIG. 1, the feed screw 3*a* is usually a ribbon feeder which has a center cavity 3*b*, surrounding the center axis 3*c*, for allowing steam to flow backwards from the defibrator 4 and through the feed screw 3*a* without interfering with the chip feed. As shown in FIG. 1 the discharge screw 2*a* usually has a soft chip plug 2*b* at the tip to prevent steam from entering the discharge screw 2*a* from the feed screw 3*a* (and also the opposite). Since wood chips have weight as compared to steam, they end up in the periphery of the ribbon feeder and are fed forwards, while the back-streaming steam 8*b* can flow backwards in the center cavity 3*b* of the ribbon feeder. The return steam 8*c* can then be evacuated from the ribbon feeder through a hole. Thus, the ribbon feeder enables efficient feeding without interference from back-streaming steam.

Figure 3:
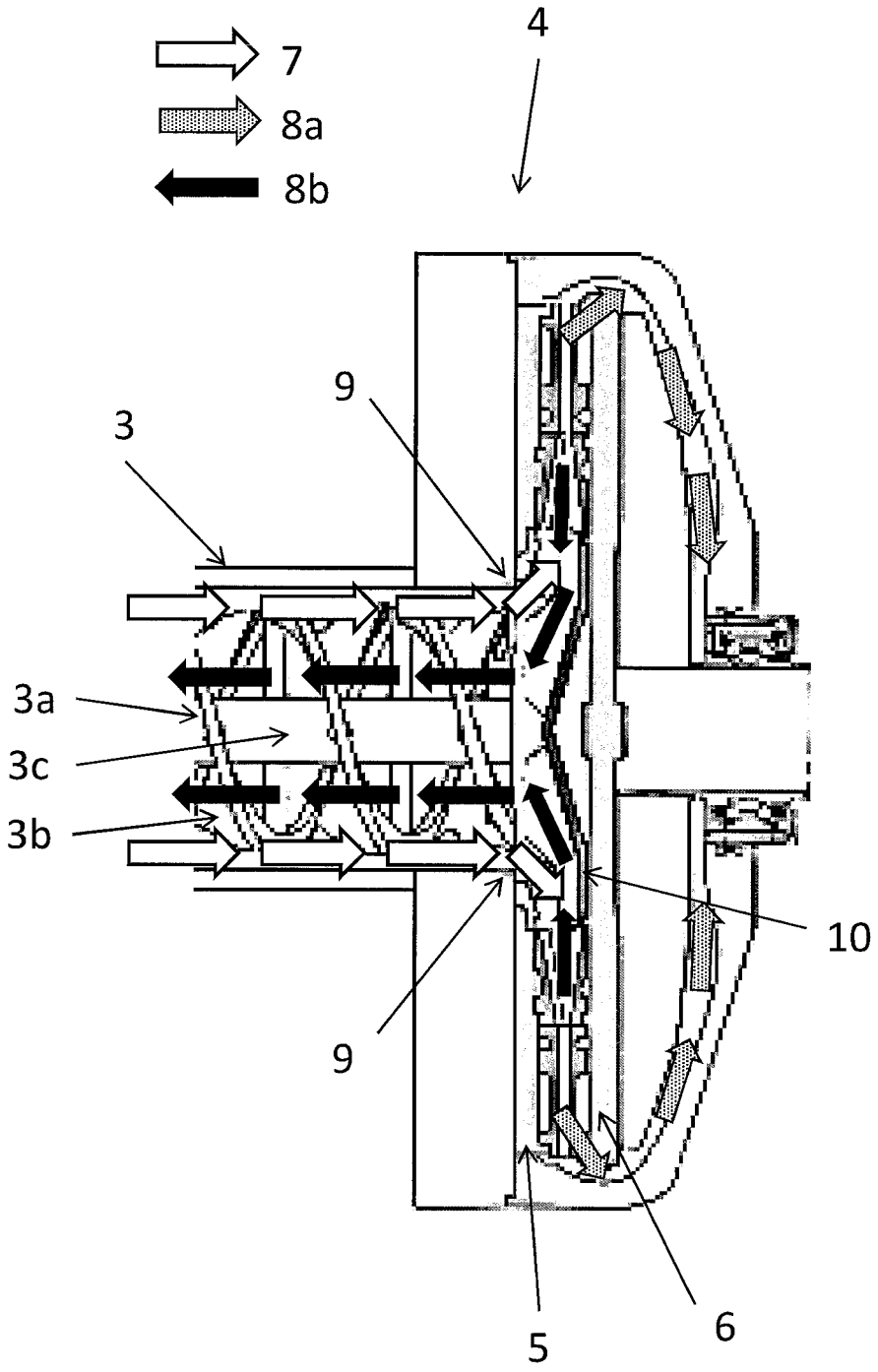
FIG. 3 is a schematic illustration of an embodiment of a typical defibrator in a refiner.

However, in order to escape through the feed screw the steam formed between the rotor and the stator first has to find its way back towards the center of the rotor and stator, working against the flow of lignocellulose-containing material being fed in the opposite direction, as illustrated in FIG. 3. Lignocellulose-containing material 7 is fed through the feed screw 3*a* into the refining gap and is then directed towards the periphery of the rotor 6 and stator 5. Some steam 8*a* is flowing forwards in the same direction as the material 7, but some of the steam 8*b* is trying to flow backwards against the flow of material 7, thus causing a feed conflict 9. This feed conflict results in unnecessary restriction of the steam flow which causes higher energy consumption, feed variations of the chips/fiber/pulp flow which causes lower fiber quality as well as higher energy consumption, and build-ups of chips/fiber/pulp in the center of the center plate. Avoiding the feed conflict would result in a more stable chip feed and less build-ups in the center plate.

Figure 4:
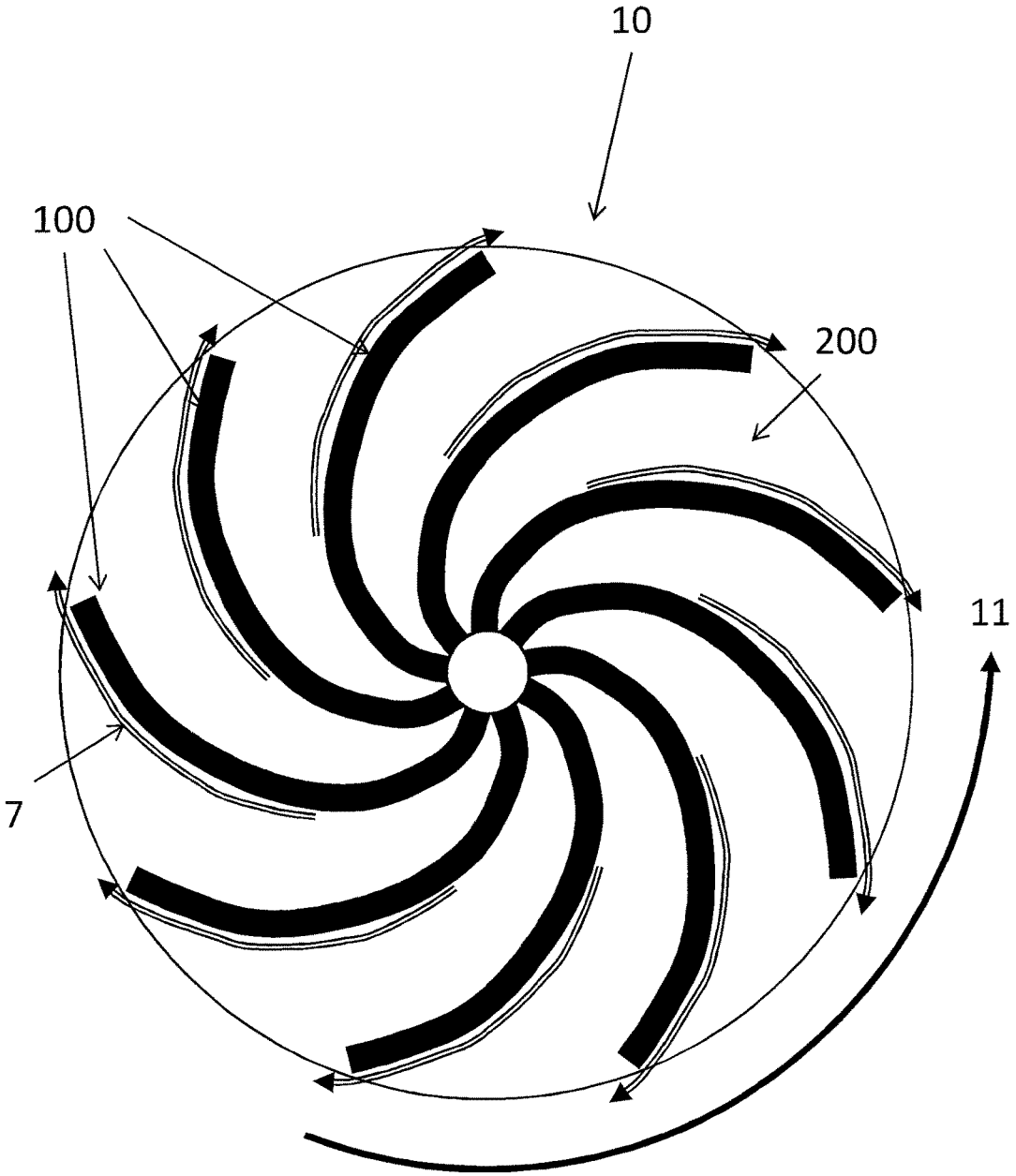
FIG. 4 is a schematic illustration of a center plate for a rotor in a refiner according to prior art.

As described above, and as illustrated in FIG. 3, the rotor 6 may be provided with a center plate 10 to help feeding the lignocellulose-containing material towards the periphery of the rotor 6 and stator 5. However, the prior art center plates, such as the center plate 10 shown in FIG. 4, all have designs which work against the flow of steam trying to escape backwards through the feed screw. The feeding wings 100 of the center plate 10 of FIG. 4 have a feeding angle designed to feed chips forwards towards the periphery of the rotor/stator, thus causing a feed conflict with the steam trying to flow in the opposite direction.

Also, the chip feeding into the center plate is never constant or even. The amount of chips fed onto the center plate will vary and that variation is not favorable to transfer into the working disc gap/refining gap. A more uniform feeding of wood chips into the refining gap results in a more uniform defibration/refining, which in turn may lead to energy savings, improvement in fiber quality and prolonged refiner segment lifetime.

Therefore, the aim of the present invention is to provide a center plate which facilitates evacuation of back-streaming steam and at the same time enables equalization of incoming feed variations.

Figure 5:
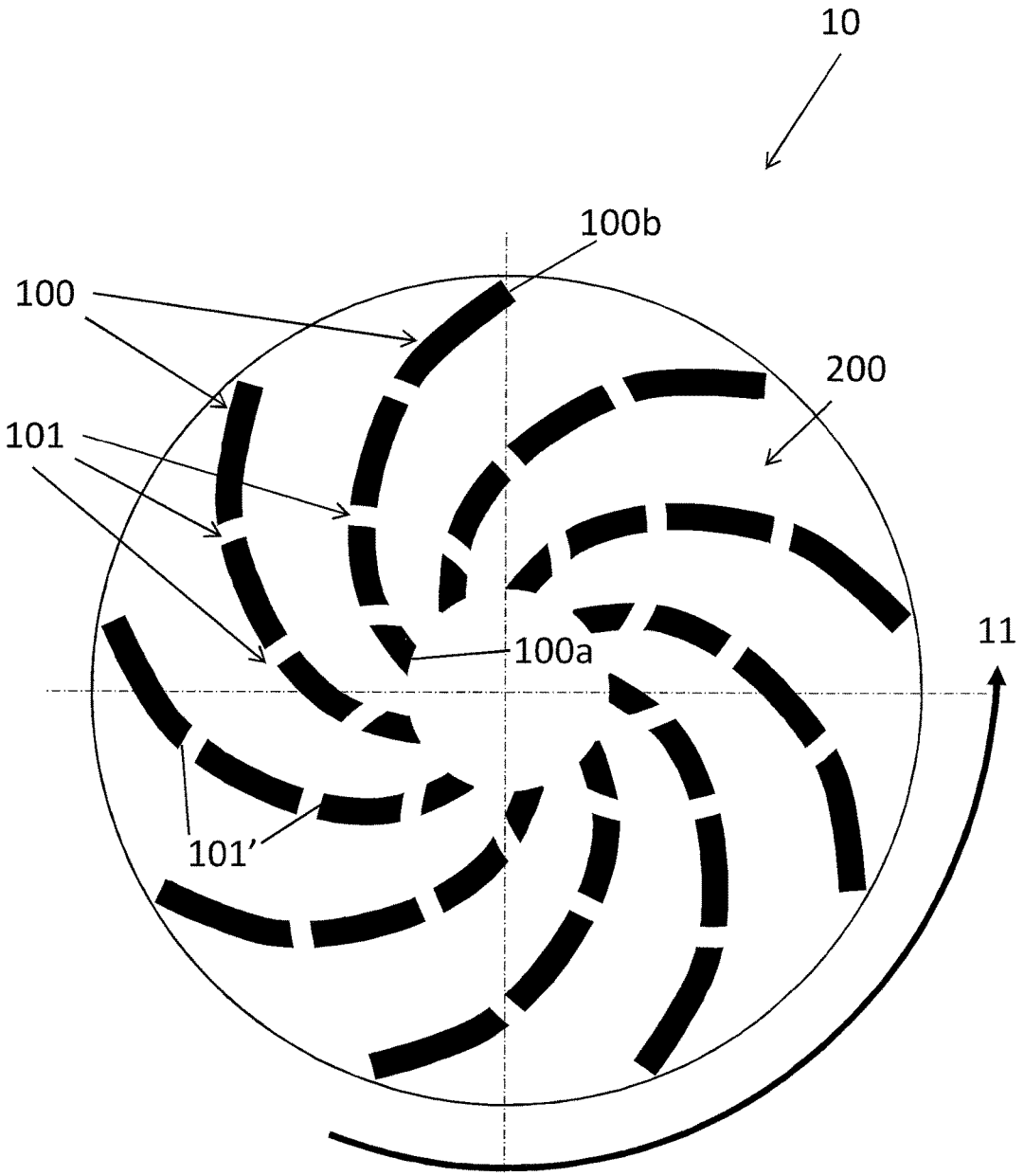
FIG. 5 is a schematic illustration of a center plate for a rotor in a refiner according to an embodiment of the present disclosure.

A center plate for a rotor in a pulp or fiber refiner according to an embodiment of the invention is illustrated in FIG. 5. The center plate 10 has a surface 200 provided with at least one feeding wing 100 for directing lignocellulose-containing material flowing onto the surface 200 towards a periphery of the center plate 10. The at least one feeding wing 100 is an elongated protrusion extending between a first end 100*a* and a second end 100*b*, where the second end 100*b* is arranged further away from a center of the center plate 10 than the first end 100*a*. The second end 100*b* is displaced relative to the first end 100*a* in a direction opposite to a direction of rotation 11 of the rotor and center plate 10. The feeding wing or wings 100 of the center plate 10 in FIG. 5 is provided with at least one opening/hole/gap 101 which allows steam to flow through the opening or openings 101 in a direction which has a component directed opposite to the direction of rotation 11, when the center plate 10 is rotating in the direction of rotation 11.

The displacement of the second end 100*b* relative to the first end 100*a* in a direction opposite to the direction of rotation 11 results in a feeding angle of the feeding wing or wings 100 that enables feeding of the lignocellulose-containing material towards the periphery of the center plate 10, when the center plate 10 is rotating in the direction of rotation 11. As described above, a feeding angle that enables feeding of the material towards the periphery of the center plate is >0° but <90°.

Depending e.g. on the size and number of openings, among other things, some of the lignocellulose-containing material may also flow through the opening or openings. Thus, in a particular embodiment the feeding wing or wings 100 is provided with at least one opening 101 which allows lignocellulose-containing material to flow through the opening or openings 101 in a direction which has a component directed opposite to the direction of rotation 11, when the center plate 10 is rotating in the direction of rotation 11.

In some embodiments the at least one feeding wing 100 is provided with a plurality of openings 101. In other embodiments the center plate 10 comprises multiple feeding wings 100, each of which comprises one or more openings 101, as illustrated in FIG. 5.

Figure 10A:
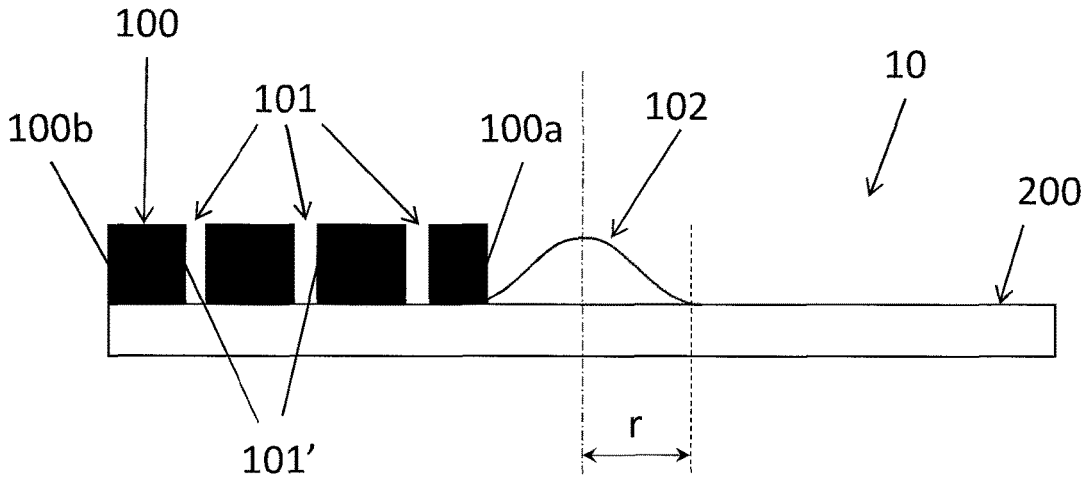
FIGS. 10A-B are schematic illustrations of a side view of a center plate for a rotor in a refiner according to other alternative embodiments of the present disclosure.
Figure 10B:
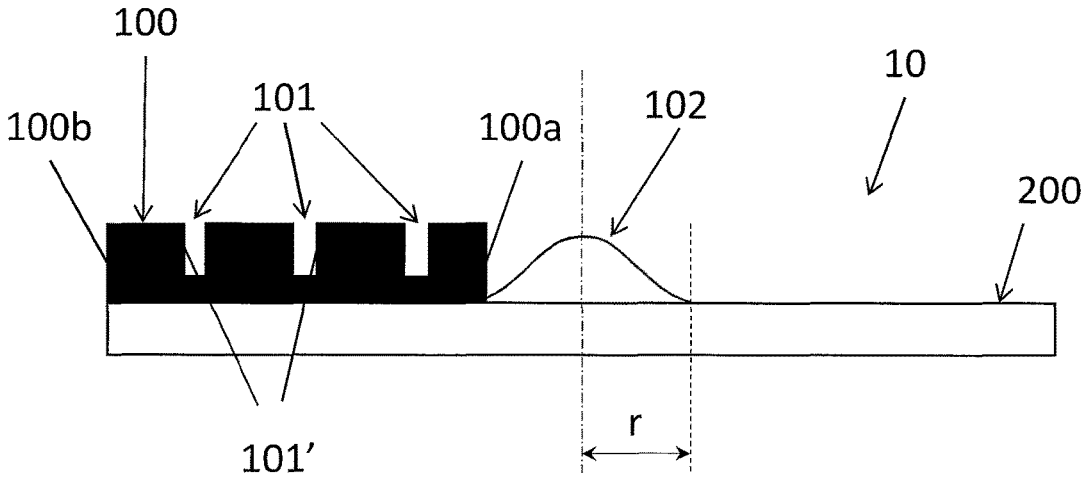

In some embodiments, one or more openings/gaps/holes 101 in the feeding wings 100 may go all the way down to the surface 200 of the center plate 10, so that the feeding wing or wings 100 are completely cut off into separate pieces, as shown e.g. in FIG. 10A. In other embodiments, one or more openings 101 do not go all the way down to the surface 200, but instead the opening or openings 101 are cut out from the feeding wing or wings 100 so that a part or parts of the feeding wing or wings 100 are left at the bottom of the opening or openings 101, as shown in FIG. 10B.

Figure 6:
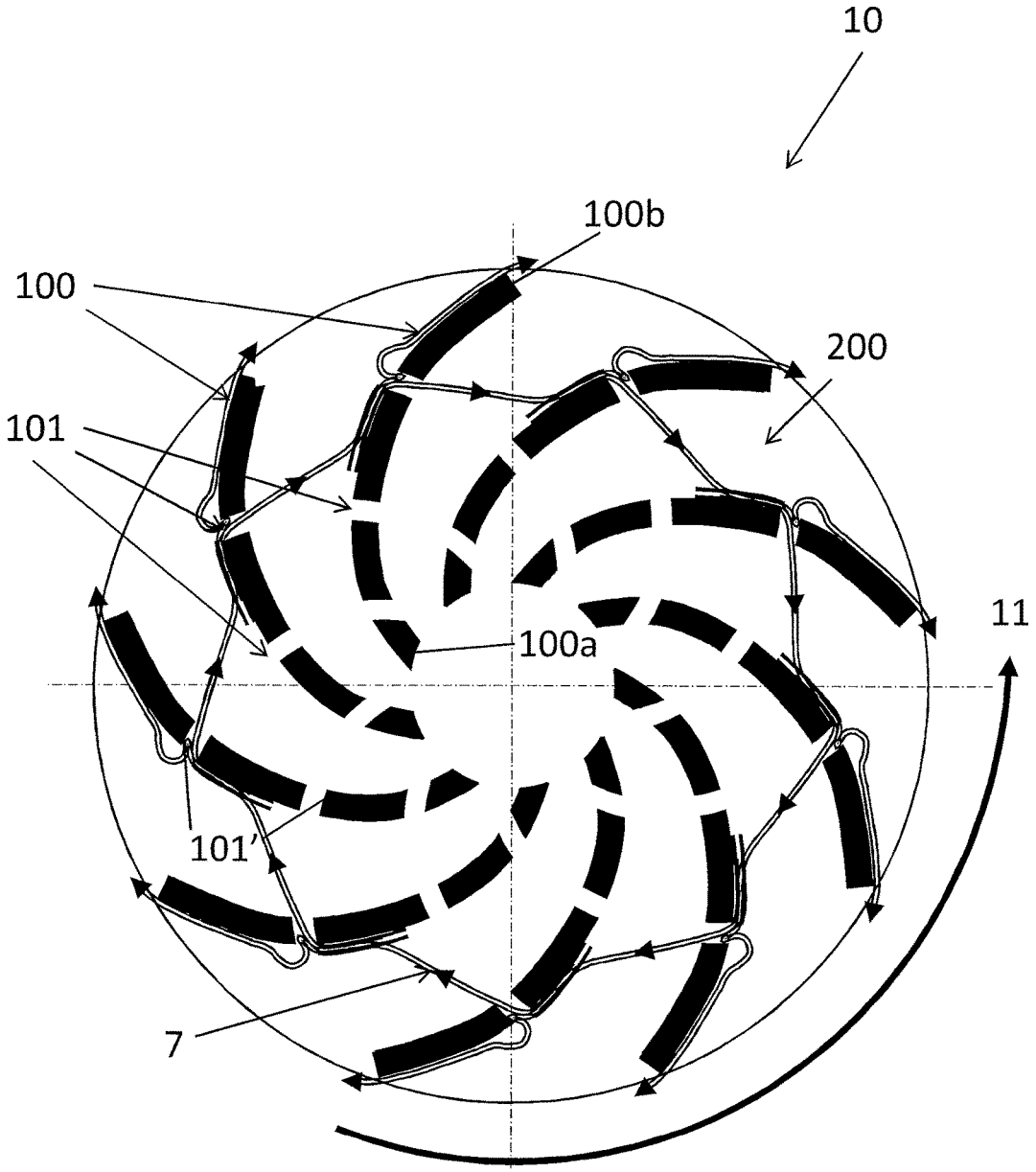
FIG. 6 is a schematic illustration of an example of how lignocellulose-containing material may flow on a center plate according to an embodiment of the present disclosure.

FIG. 6 illustrates an example of how the lignocellulose-containing material 7 may flow on the center plate 10 according to the embodiment of FIG. 5. The material 7 flows on the surface 200 and some of the material 7 may be directed to flow along the feeding wings 100 in a main direction towards the periphery of the center plate 10, when the center plate 10 is rotating in the direction of rotation 11. The material 7 may of course also flow in other directions, but since the lignocellulose-containing material should eventually end up in the refining gap in order to be refined, this is the preferred direction of flow of the material 7. Depending on e.g. the size and number of the openings, some of the material may 7 enter through the openings 101 and flow towards an adjacent feeding wing 100 in a main direction opposite to the direction of rotation 11 in some embodiments. The openings 101 in the wings 100 may create turbulence when the material 7 flows through them, which will cause buffering/equalization of the material flow resulting in less variation in material feed. The openings will in such embodiments also cause a more even distribution of material over the center plate, since the material can flow through the openings to a next wing. Less material feed variations will result in a more stable disc gap, whereas a better distribution of material will result in a more stable as well as a more open disc gap. This will in turn result in less energy consumption, more uniform fiber quality and longer segment lifetime.

Figure 7:
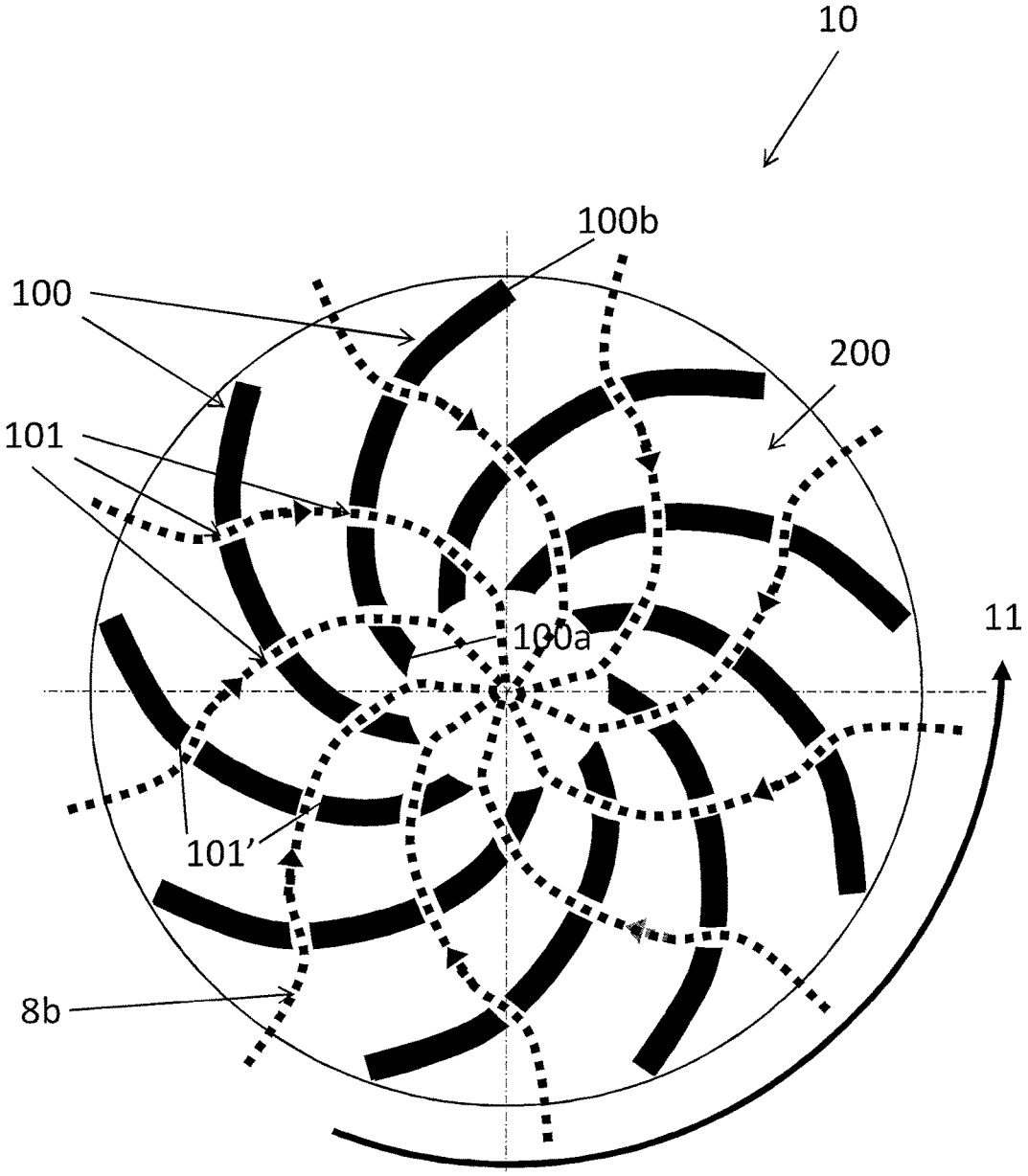
FIG. 7 is a schematic illustration of an example of how back-streaming steam may flow on a center plate according to an embodiment of the present disclosure.

FIG. 7 illustrates an example of how back-streaming steam 8*b* can flow on the center plate 10 according to the embodiment of FIG. 5. The back-streaming steam 8*b* wants to flow in a main direction towards the center of the center plate 10 in order to escape through the feed screw. The steam 8*b* flows on the surface 200 and is allowed to flow through the openings 101 in the feeding wings 100 in a main direction opposite to the direction of rotation 11. Thus, the openings create a passage for back-streaming steam 8*b*, which makes it easier for the steam 8*b* to find its way to the center of the center plate 10, and hence there will be less restriction for the back-streaming steam and less feeding conflicts with the material flow feed, which results in less variations in material feed. As mentioned above, less material feed variations will result in a more stable disc gap, which in turn results in less energy consumption, more uniform fiber quality and longer segment lifetime.

Figure 8:
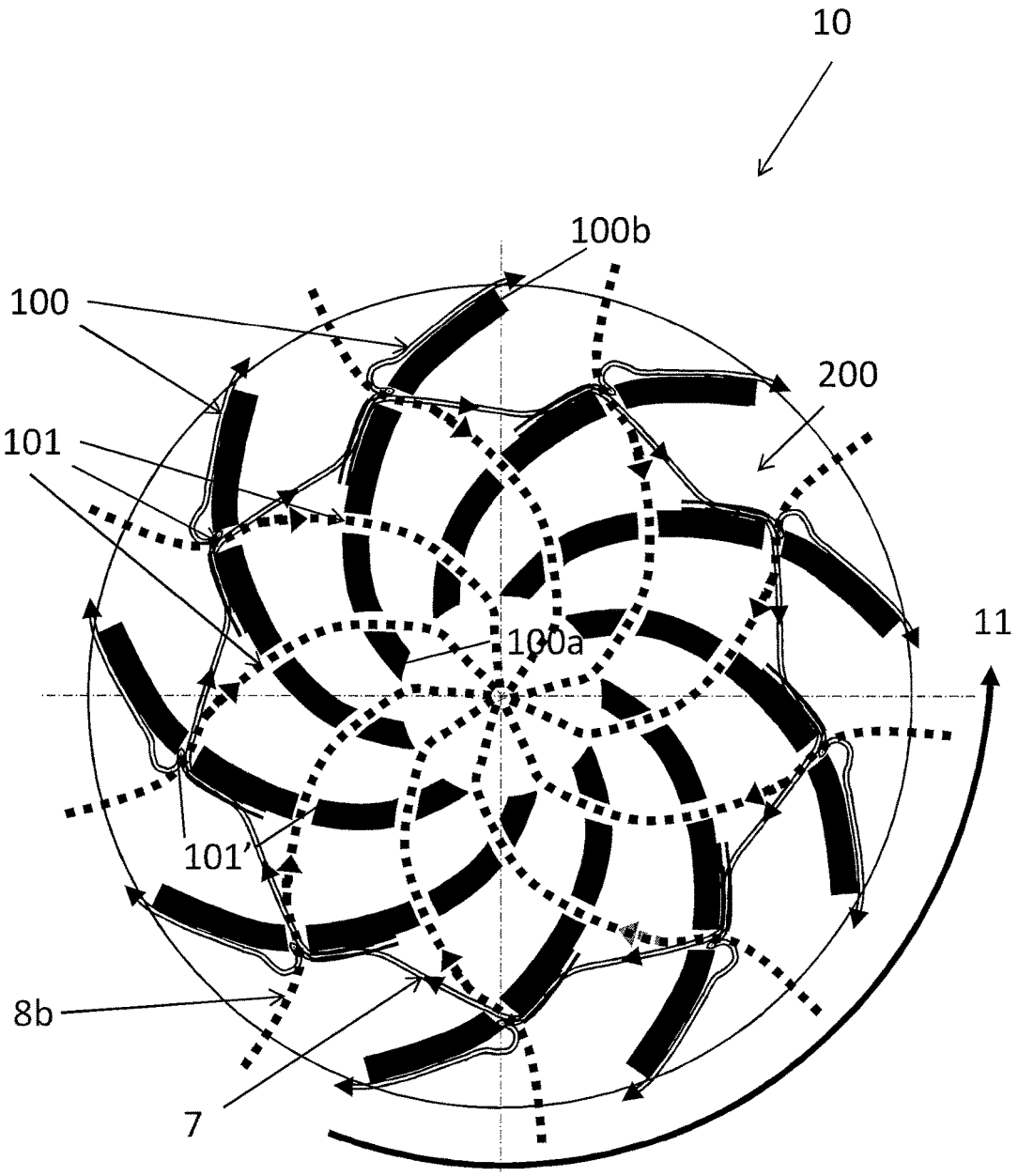
FIG. 8 is a schematic illustration of an example of how both lignocellulose-containing material and back-streaming steam may flow on a center plate according to an embodiment of the present disclosure.

FIG. 8 illustrates an example of both the flow of lignocellulose-containing material 7 and the flow of back-streaming steam 8*b* on the center plate 10 according the embodiment of FIG. 5.

According to a particular embodiment, such as illustrated in FIGS. 5-8, at least one opening 101 in a feeding wing 100 is arranged such that at least a side wall 101' of the opening 101 is directed obliquely towards the center of the center plate 10, i.e. the side wall 101' is directed in a direction having a component directed towards the center of the center plate 10 and a component directed opposite to the direction of rotation 11 of the center plate 10. The inclination of the side wall 101' is intended for guiding the steam 8*b* to flow through the opening 101 obliquely towards the center of the center plate 10, when the center plate 10 is rotating in the direction of rotation 11, as illustrated in FIG. 7. The angle of the side wall 101' may be varied between 0° and 90° in different embodiments, where 0° in this case is a direction opposite to the direction of rotation 11, and 90° is a radial direction towards the center of the center plate 10.

By varying the angle of the side wall 101', the direction of the steam flow can be varied in different embodiments. Also, the angle of the side wall 101' affects how easy it will be for the lignocellulose-containing material 7 to flow through the opening 101. The more the side wall 101' is directed towards the center of the center plate 10, the more difficult it will be for the material 7 to flow through the opening 101 when the center plate is rotating, due to the weight of the material.

Thus, the amount of lignocellulose-containing material 7 flowing through the opening or openings 101 depends, among other things, on the size, number and angle of the opening or openings 101, and also on the size, number and angle of the feeding wing or wings 100.

In a particular embodiment, the surface 200 of the center plate 10 is provided with at least two feeding wings 100. A side wall 101' of an opening 101 in a first feeding wing 100 is inclined as described above, and is directed towards an opening 101, also with an inclined side wall 101', in the next feeding wing 100, for guiding the steam 8*b* to flow through the openings 101 obliquely towards the center of the center plate 10, when the center plate 10 is rotating in the direction of rotation 11. This is illustrated in FIG. 7. Since the side walls 101' of the openings 101 are inclined as described above, the arrangement of the openings 101 in this embodiment creates an "intended path" which is directed obliquely towards the center of the center plate, and along which the steam 8*b* may flow. The term "intended path" indicates that this is a preferred path that would be preferable for the steam to follow, but of course the steam may also flow in other directions. However, the intention of the arrangement of the openings 101 is to make it possible for the back-streaming steam to follow this path in order to facilitate for the steam to reach the center of the center plate and escape through the feed screw. Since the angle of the side walls 101' may be varied between 0° and 90°, where 0° in this case is a direction opposite to the direction of rotation 11, and 90° is a radial direction towards the center of the center plate 10, the angle of the intended path on the center plate 10 may also be varied between 0° and 90° in different embodiments.

In particular embodiments the center plate 10 comprises a plurality of feeding wings 100, each of which comprises at least one opening 101 with at least a side wall 101' being inclined as described above. The openings 101 in the feeding wings 100 are arranged such that at least one intended path as described above is created by the openings 101, for guiding the steam to flow through the openings 101 along the intended path or paths and obliquely towards the center of the center plate 10, when the center plate 10 is rotating in the direction of rotation 11, as illustrated in FIG. 7. The number of intended paths and their angles on the center plate may differ in different embodiments. Again, the purpose of the "intended paths" is to facilitate for the back-streaming steam to reach the center of the center plate and escape through the feed screw. Hence there will be less restriction for the back-streaming steam and less feeding conflicts with the material flow feed, as mentioned above.

Figure 9:
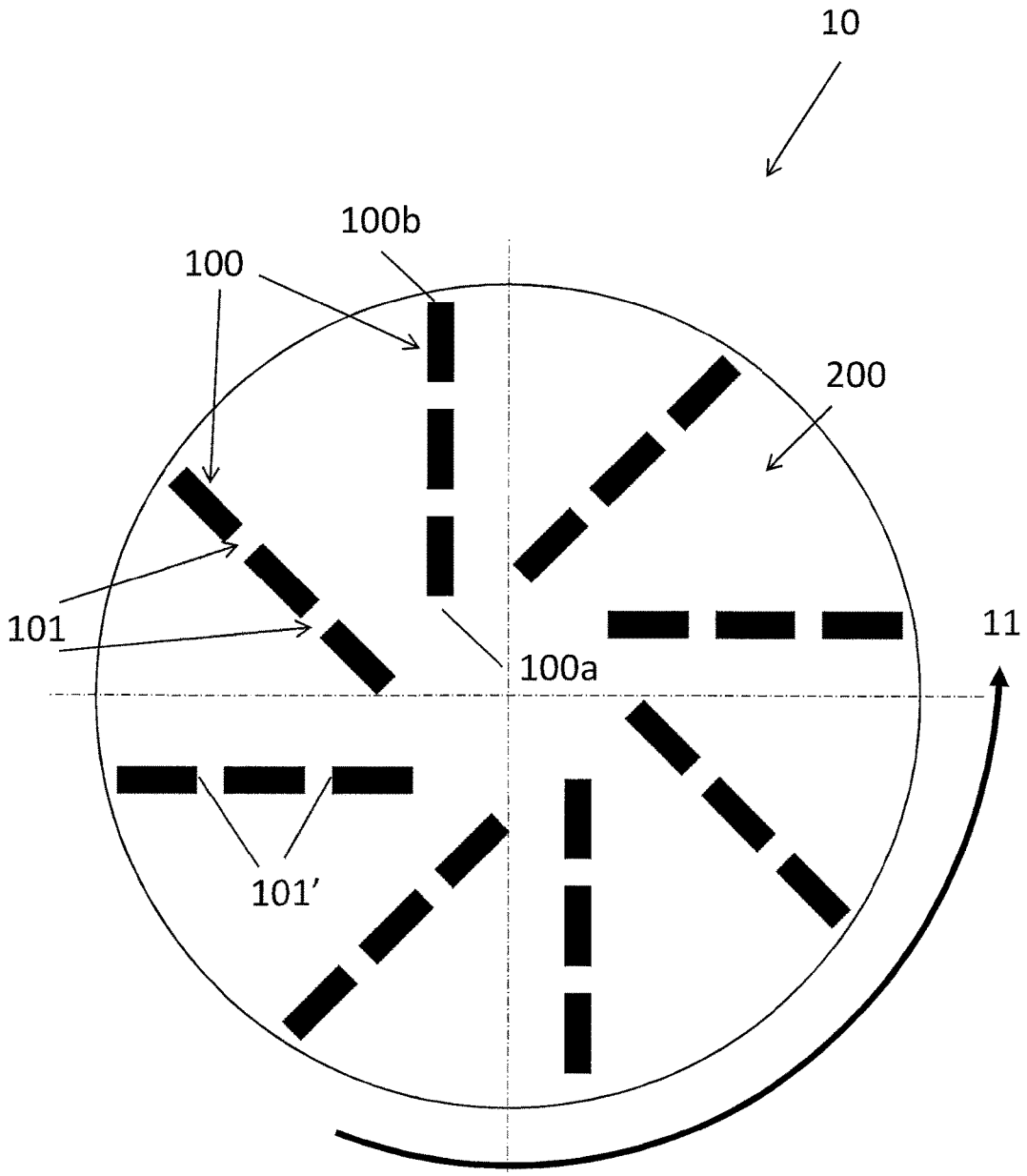
FIG. 9 is a schematic illustration of a center plate for a rotor in a refiner according to an alternative embodiment of the present disclosure.

The feeding wing or wings of the center plate 10 may be curving/bending/arching in a direction opposite to the direction of rotation 11 in an embodiment. The exact shape of the curved feeding wing or wings may differ in different embodiments, as an example the feeding wing or wings may be arc-shaped in a particular embodiment. The angle of curvature may also vary along the wing in other embodiments. Curved feeding wings are quite common in the art and have proven to provide efficient material distribution on the center plate, but other shapes of the feeding wings may also be possible in alternative embodiments. As an example, straight feeding wings may be easy to manufacture and FIG. 9 shows an example embodiment of a center plate 10 with straight feeding wings 100. Also, the number of wings and their angles on the center plate may differ in different embodiments, but the wings should always have a feeding angle that enables feeding of the lignocellulose-containing material towards the periphery of the center plate when the rotor and center plate are rotating in the direction of rotation, i.e. the feeding angle of the feeding wings should be >0° and <90°.

In a particular embodiment, the second end 100*b* of the feeding wing or wings 100, i.e. the outer end or the end being closest to the periphery of the center plate 10, is arranged at the periphery of the center plate 10.

In a particular embodiment, the first end 100*a* of the feeding wing or wings 100, i.e. the inner end or the end being closest to the center of the center plate 10, is displaced from the center of the center plate 10, i.e. the feeding wing or wings do not go all the way to the center of the center plate 10. For e.g. straight feeding wings this is a necessary condition in order to achieve a feeding angle of >0°.

In order to facilitate for the back-streaming steam to escape through a hollow feed screw or ribbon feeder feeding lignocellulose-containing material onto the center plate, it may be advantageous if there is a space between the inner ends of the feeding wings and the center axis of the feed screw, the space allowing steam to flow from the surface of center plate, along the center axis of the feed screw, and escape through the feed screw. Therefore, in an embodiment the first end 100*a* of the feeding wing or wings 100 is displaced from the center of the center plate 10, at a distance which is larger than the radius of the end of the center axis 3*c* of the hollow feed screw 3*a*, see FIGS. 1 and 3, where the end is located adjacent to the surface 200 of the center plate 10.

In some embodiments, the surface 200 of the center plate 10 is provided with a rotationally symmetric protuberance or bulge/bump with its center coinciding with the center of the center plate. This is illustrated in a side view of an embodiment of a center plate 10 in FIGS. 10A-B. The center plate 10 in FIGS. 10A-B has a surface 200 provided with a feeding wing 100 comprising several openings 101 and a central protuberance 102, shaped as a knob or rounded hill in this embodiment. For simplicity, only one feeding wing 100 is shown in the embodiments of FIGS. 10A-B, but of course the center plate 10 could comprise two or more feeding wings 100. The height and width of the protuberance and e.g. the shape and inclination of its lateral/side wall/surface may vary in different embodiments. Other shapes of the protuberance are also possible in other embodiments, such as e.g. a sphere, a cylinder, a cone or a frustum of a cone, but preferably the protuberance 102 is a smooth protuberance without sharp edges, to avoid possible irregularities in the flow which could lead to a turbulent motion of the chips/fiber/pulp.

The main purpose of a central protuberance is to avoid lignocellulose-containing material from building up at the center of the center plate. The material falling into the central area of the center plate will be pushed away by the protuberance towards the feeding wings. Furthermore, the protuberance has the purpose of strengthening the central area of the center plate. Since the lignocellulose-containing material will mainly fall into the central area of the center plate and change direction there, i.e. change from an axial motion along the feeding axis to a radial motion along the surface of the center plate, significant forces will be applied on the sides of the feeding wings from the lignocellulose-containing material. By providing the center plate with a central protuberance a more robust center plate is obtained since the height of the feeding wings above the protuberance is smaller than the height of the wings above an essentially flat surface.

To ensure that the central protuberance 102 does not constitute an obstacle for the back-streaming steam 8*b* trying to escape through the feed screw, it may be advantageous if there is a space between the inner ends, i.e. the ends closest to the center of the center plate 10, of the feeding wings 100 and the lateral wall/surface of the protuberance 102, the space allowing steam to flow from the surface of the center plate, along the center axis of the feed screw, and escape through the feed screw. Therefore, in an embodiment the first end 100*a* of the feeding wing or wings 100 is displaced from the center of the center plate 10, at a distance which is larger than a radius of the protuberance 102.

If the protuberance is cylindrical in shape, the radius is of course constant over the height of the protuberance, but if the protuberance is shaped as a rounded hill as in FIGS. 10A-B, or e.g. as a cone or a frustum of a cone, or even a sphere, the radius varies with the height of the protuberance. Thus, depending on which radius is used as a reference for the displacement of the first end 100*a* of the feeding wing or wings 100, the first end 100*a* may in the case of a protuberance shaped as e.g. a rounded hill, cone or frustum be located somewhere on the inclining wall of the protuberance, i.e. the feeding wing or wings 100 and the protuberance 102 may overlap in some embodiments. Depending on the displacement of the first end 100*a*, the size of the space for allowing steam to escape will vary, i.e. a larger displacement of the first end 100*a* relative to the center of the center plate 10 will result in a larger space for the steam to escape. In a particular embodiment, the first end 100*a* of the feeding wing or wings 100 is displaced from the center of the center plate 10 at a distance which is larger than a largest radius r of the protuberance 102. This is illustrated in FIGS. 10A-B, where the radius r in this particular case is measured at the surface 200 of the center plate 10, since this protuberance is widest/has the largest radius at the surface 200 of the center plate 10.

As described above, the surface of the center plate can be provided with one or more feeding wings. In some embodiments, the surface 200 of the center plate 10 is provided with a plurality of feeding wings 100. In a particular embodiment the first ends 100*a* of the feeding wings 100 are symmetrically distributed with respect to the center of the center plate 10. In another particular embodiment the second ends 100*b* of the feeding wings 100 are symmetrically distributed with respect to the center of the center plate 10.

By having wings feeding "intermittently" due to the openings/gaps/holes in the feeding wings according to the present invention, at least the following advantages can be achieved:

- The steam can more easily enter the feed screw and escape, resulting in less feed conflicts, which in turn leads to lower energy consumption, less feed variations and less build-ups of material in the center of the center plate
- Less wood chip feed variations are transferred into the working disc gap, which means that a more open disc gap can be used to achieve the same defibration/refining, which results in lower specific energy (SEC) for the same fiber quality, more uniform fiber quality, longer overall fiber length and longer refiner segment lifetime.

In summary, the openings/gaps/holes in the feeding wings of the center plate according to the present invention enable improved equalization of feed variations as well as facilitated steam evacuation in a pulp or fiber refiner.

All embodiments of a center plate 10 according to the present disclosure can be fitted to a rotor arrangement of well-known pulp/fiber refiners. One example of such a pulp/fiber refiner 1 is schematically described above with reference to FIG. 1. Other refiners are however also possible to use in connection with a center plate 10 according to the present disclosure. Such refiners include refiners with two rotors instead of a rotor-stator arrangement, e.g. two rotors that can be rotated independently.

The embodiments described above are merely given as examples, and it should be understood that the proposed technology is not limited thereto. It will be understood by those skilled in the art that various modifications, combinations and changes may be made to the embodiments without departing from the present scope as defined by the appended claims. In particular, different part solutions in the different embodiments can be combined in other configurations, where technically possible.

The invention claimed is:

1. A center plate for a rotor in a pulp or fiber refiner, said center plate having a surface provided with at least one feeding wing for directing lignocellulose-containing material flowing onto said surface towards a periphery of the center plate, where said at least one feeding wing is an elongated protrusion extending between a first end and a second end, said second end being arranged further away from a center of the center plate than said first end, and said second end being displaced relative to said first end, in a direction opposite to a direction of rotation of the rotor and center plate, wherein said at least one feeding wing is provided with at least one opening allowing a steam to flow through said at least one opening in a direction having a component directed opposite to the direction of rotation, when the center plate is rotating in the direction of rotation.

2. The center plate according to claim 1, wherein said at least one opening allows lignocellulose-containing material to flow through said at least one opening in a direction having a component directed opposite to the direction of rotation, when the center plate is rotating in the direction of rotation.

3. The center plate according to claim 1, wherein said at least one opening is arranged such that at least a side wall of said opening is directed in a direction having a component directed towards the center of the center plate and a component directed opposite to the direction of rotation of the center plate, for guiding steam to flow through the opening obliquely towards the center of the center plate, when the center plate is rotating in the direction of rotation.

4. The center plate according to claim 3, wherein said surface is provided with at least two feeding wings and a side wall of an opening in a first feeding wing is directed towards an opening in a second feeding wing, for guiding steam to flow through said openings obliquely towards the center of the center plate, when the center plate is rotating in the direction of rotation.

5. The center plate according to claim 1, wherein said at least one feeding wing is curving in a direction opposite to the direction of rotation.

6. The center plate according to claim 1, wherein said at least one feeding wing is straight.

7. The center plate according to claim 1, wherein said second end of said at least one feeding wing is arranged at the periphery of the center plate.

8. The center plate according to claim 1, wherein said first end of said at least one feeding wing is displaced from the center of the center plate.

9. The center plate according to claim 8, wherein said first end of said at least one feeding wing is displaced from the center of the center plate at a distance larger than a radius of an end of a center axis of a hollow feed screw, said end being located adjacent to said surface of said center plate.

10. The center plate according to claim 8, wherein said surface is provided with a rotationally symmetric protuberance with its center coinciding with the center of the center plate.

11. The center plate according to claim 10, wherein said first end of said at least one feeding wing is displaced from the center of the center plate at a distance larger than a radius of said protuberance.

12. The center plate according to claim 11, wherein said first end of said at least one feeding wing is displaced from the center of the center plate at a distance larger than a largest radius of said protuberance.

13. The center plate according to claim 1, wherein said at least one feeding wing is provided with a plurality of openings.

14. The center plate according to claim 1, wherein said surface is provided with a plurality of feeding wings.

15. The center plate according to claim 14, wherein the first ends of the plurality of feeding wings are symmetrically distributed with respect to the center of the center plate.

16. The center plate according to claim 14, wherein the second ends of the plurality of feeding wings are symmetrically distributed with respect to the center of the center plate.

17. A pulp or fiber refiner with a rotor comprising the center plate according to claim 1.

* * * * *